United States Patent [19]

Wilson

[11] 4,054,003

[45] Oct. 18, 1977

[54] FIREARM SAFETY DEVICE

[76] Inventor: Hugh R. Wilson, 10840 SW. 120th St., Miami, Fla. 33176

[21] Appl. No.: 730,647

[22] Filed: Oct. 7, 1976

[51] Int. Cl.[2] ..... F41C 17/04
[52] U.S. Cl. ..... 42/70 F
[58] Field of Search ..... 42/70 F

[56] References Cited

U.S. PATENT DOCUMENTS

| | | | |
|---|---|---|---|
| 547,933 | 10/1895 | Mauser | 42/70 F |
| 1,073,491 | 9/1913 | Holland et al. | 42/70 F |
| 2,484,977 | 10/1949 | Wilcox | 42/70 F |
| 2,819,551 | 1/1958 | Baierl | 42/70 F |

FOREIGN PATENT DOCUMENTS

| | | | |
|---|---|---|---|
| 638,052 | 11/1936 | Germany | 42/70 F |

*Primary Examiner*—Charles T. Jordan

[57] ABSTRACT

This invention is that of an improvement in a safety mechanism for locking the firing pin and bolt of firearms of the Mauser type.

This device may be installed without alteration or modification to the firearm or to its component parts, and may be removed if desired, leaving the firearm in its original form.

The device has a body containing a swinging claw-wedge which engages the firing pin and a plunger which engages the rear of the rifle breechbolt when the device is actuated by a lever mounted on a shaft mounted in the body of the device.

4 Claims, 15 Drawing Figures

FIREARM SAFETY DEVICE

FIELD OF THE INVENTION

This invention relates to firearms to be used for sporting purposes and for target shooting, and is intended to be used with rifles of the Mauser type.

DESCRIPTION OF THE PRIOR ART

The original Mauser safety mechanism used a "Wing" type lever and was intended primarily for military purposes. The "Wing" type lever, while very reliable, is slow to use and presents serious problems when a telescope is mounted on a rifle as the "Wing" safety lever cannot be easily and quickly reached and operated.

This invention provides a safety mechanism in which the operating lever is readily accessable at all times, even when a telescope of low profile is mounted on the rifle, and it is very quick and easy to operate.

When the original Mauser type safety lever is removed, this new and novel device may be easily installed on the rifle without special tools or equipment and unlike the device shown in the Wilcox U.S. Pat. No. 2,484,977, no new machine work or alteration is required to be performed on the rifle or any of its component parts. If so desired, this device can be removed from the rifle, restoring the rifle to its original form.

SUMMARY OF THE INVENTION

This invention provides a new and novel safety mechanism that is quickly and easily operated, can be used in combination with a low mounted telescope, can be easily and quickly installed on a rifle without the need or use of special tools or equipment, and can be installed on a rifle without any modification of the rifle. The novelty of this invention will become more apparent in the specification and claims.

DETAILED DESCRIPTION

Figure 1:
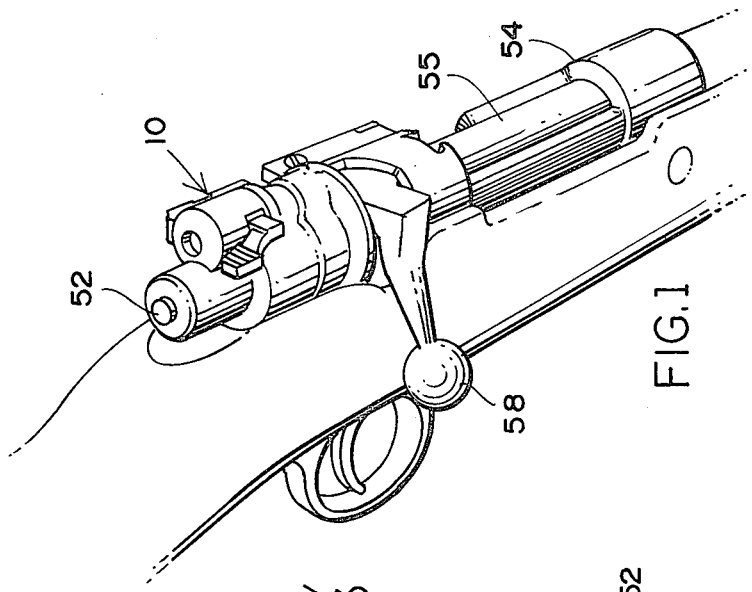
FIG. 1 shows the device installed on the action of a rifle. The actuating lever is in the safe position.
Figure 2:
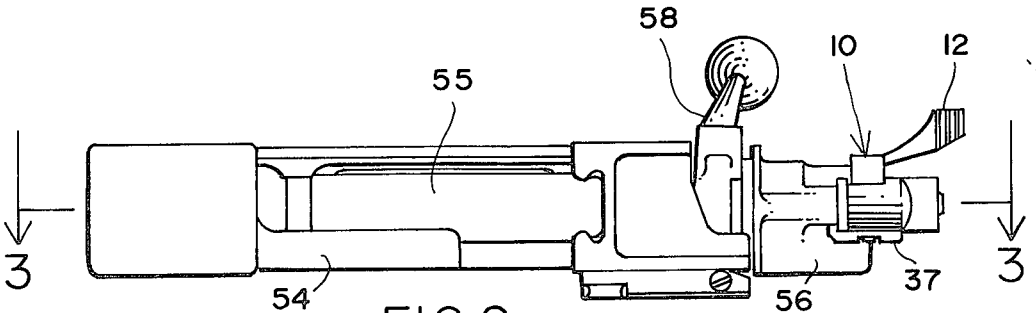
FIG. 2 shows a top view of a rifle action with the device installed and the actuating lever in the safe position.
Figure 3:
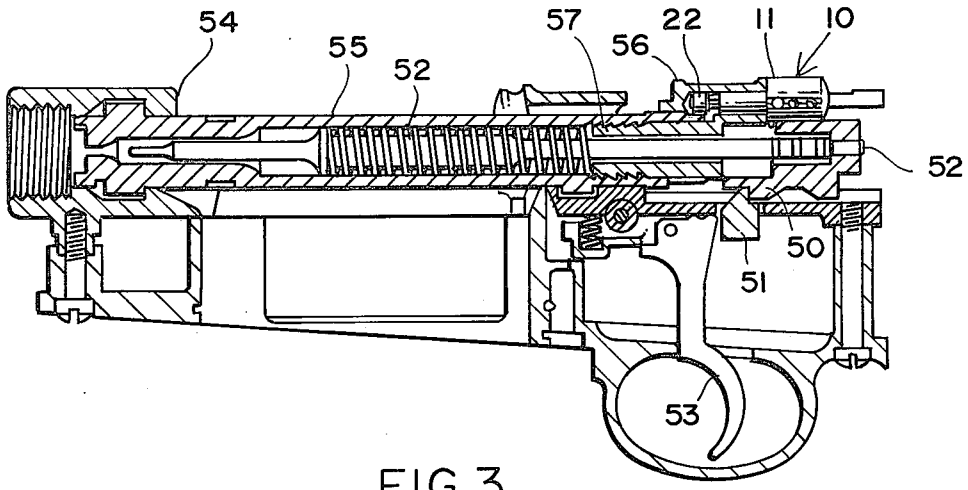
FIG. 3 shows the component parts of a rifle with the device installed and in a safe or second position.
Figure 7:
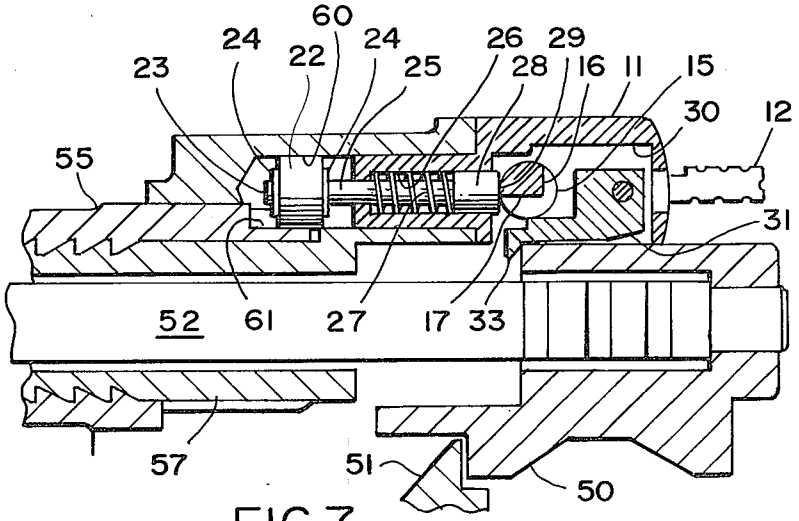
FIG. 7 is a detailed sectional view showing the device in a safe or second position.
Figure 8:
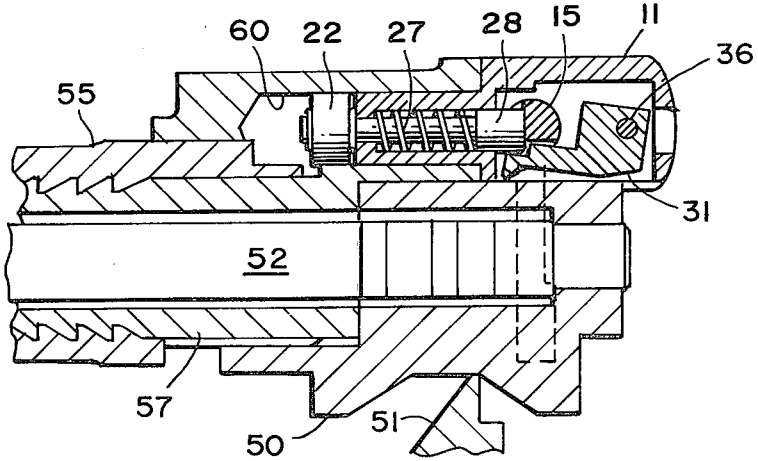
FIG. 8 is a detailed sectional view showing the device in a first or firing position and the firing pin of a rifle action in a fired position.
Figure 5:
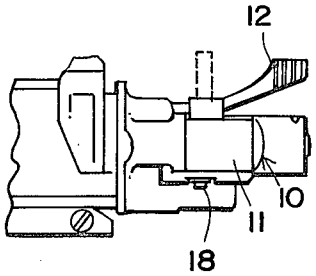
FIG. 5 is a top view with the actuating lever in the safe or second position.
Figure 6:
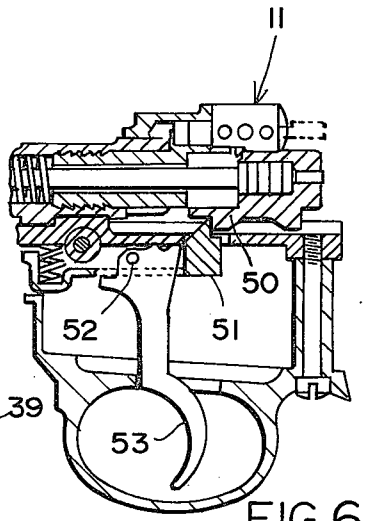
FIG. 6 is a sectional view showing the device in a safe or second position.
Figure 4:
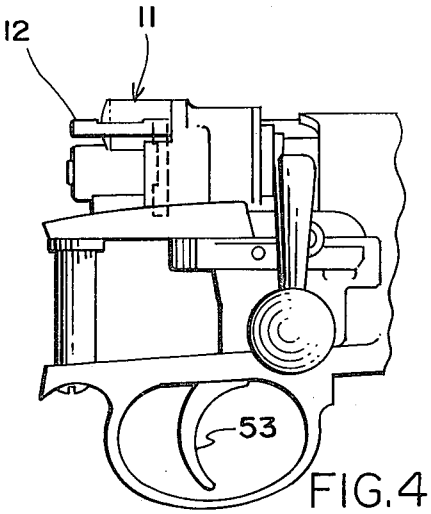
FIG. 4 is an external side view with the actuating lever in a safe or second position.
Figure 9:
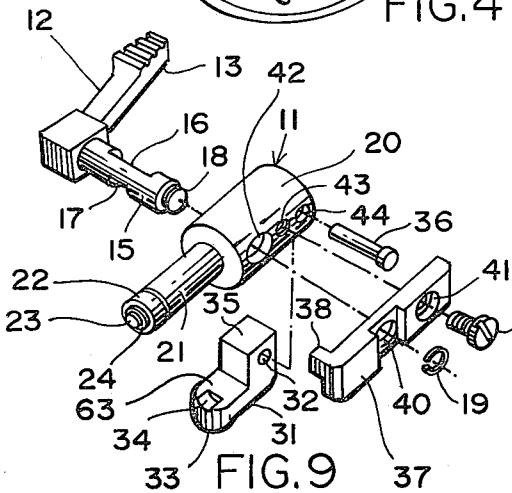
FIG. 9 is an exploded view of the device and showing a horizontal actuating shaft.
Figure 13:
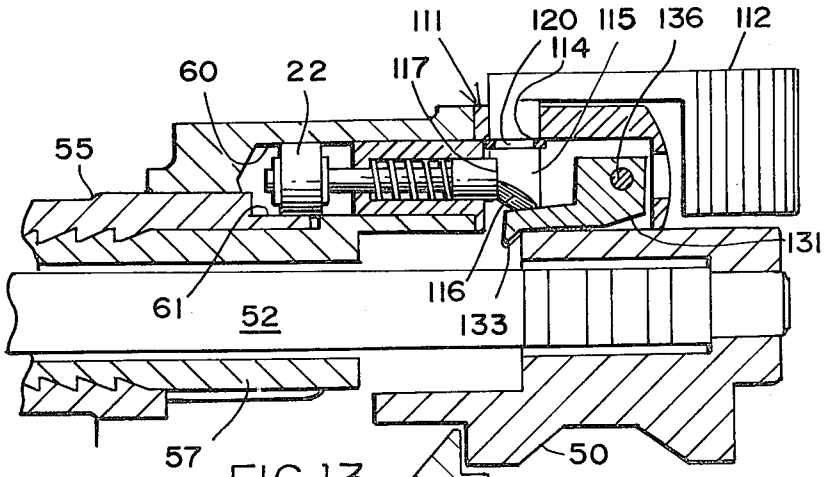
FIG. 13 is a detailed sectional view of the vertical shaft device with the mechanism in the safe or second position.
Figure 14:
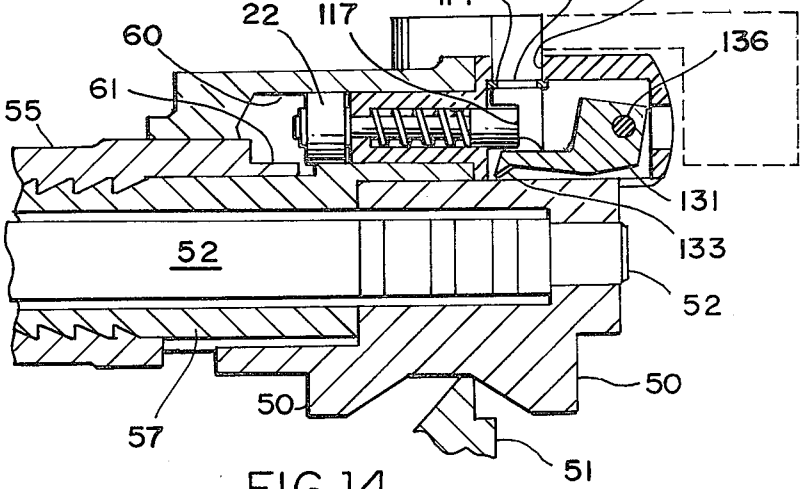
FIG. 14 is a detailed sectional view of the vertical shaft device mechanism in a firing or first position and the firing pin of a rifle in a fired position.
Figure 11:
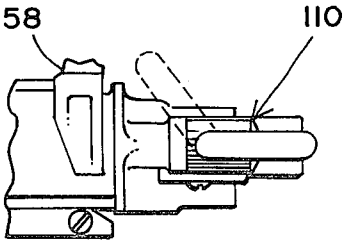
FIG. 11 is a top view showing the device with the vertical actuating shaft and in the safe or second position.
Figure 12:
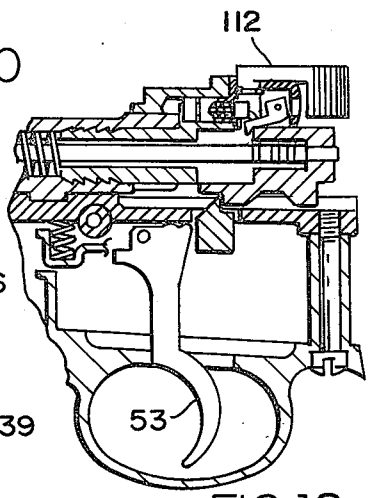
FIG. 12 is a sectional side view showing the device with the vertical actuating shaft and in a safe or second position.
Figure 10:
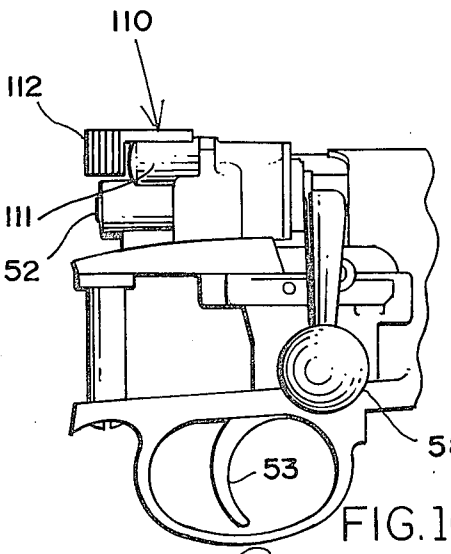
FIG. 10 is an external side view showing the device with a vertical actuating shaft and in a safe or second position.
Figure 15:
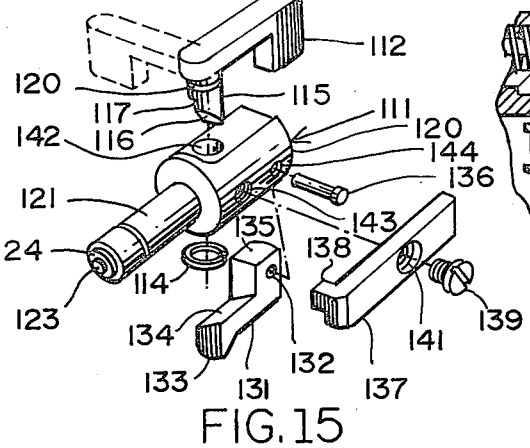
FIG. 15 is an exploded view of the vertical shaft device showing the component parts in detail.

Referring to the drawings by characters of reference, FIGS. 1 to 9 illustrate the invention as used with a horizontal actuating shaft.

FIGS. 10 to 15 illustrate the invention as used with a vertical actuating shaft.

FIG. 1 shows the device 10 installed on a rifle. The forward part of the body 11 is of a reduced diameter so as to fit into the bore 60 in the rifle bolt mechanism.

The body 11 is held in place by the clamp 37 which is secured to the body 11 by a screw 39.

A holding member 35 is mounted within the cavity 30 of the body 11 and is held by pin 36 which extends through hole 44 of the body 11 and through the bore 32 in holding member 35.

The actuating shaft 15 extends through the bore 42 in the body 11, through hole 40 in clamp 37 and is retained by the spring snap ring 19 in groove 18.

The locking plunger 28 is in the bore 26 of the body 11 and is held against the shaft 15 by the tension of compression spring 27. The plunger head 22 is held in place on plunger 28 by the two spring snap rings 24.

The actuating shaft 15 is provided with a flat surface 16 which engages the surface 63 of the holding member 35 when the mechanism is in a first position, and provides clearance for the holding member 35 to move out of engagement with the firing pin head 50 when the actuating shaft 15 moves to the first position after having been moved to the second position.

The holding member 35 is provided with an angled projection 33 which engages the forward part of the firing pin head 50 when the mechanism is moved to a second position, said angled projection 33 forcing the firing pin head 50 slightly rearward out of engagement with the trigger sear 51, said firing pin head 50 is now held in the second or safe position by the holding member 35 which is held in the second position by the periphery of the actuating shaft 15 which has been rotated to the second position. When the actuating shaft 15 is moved back to the first or firing position, the angled projection 33 of holding member 35 is forced upward and out of engagement with the firing pin head 50 by the force of the firing pin spring of the rifle and into the slot 16 in the actuating shaft 15 as the firing pin head 50 returns to engagement with the trigger sear 51, the rifle mechanism now being in a firing position.

The actuating shaft 15 is also provided with the slot 17 the flat surface of which engages the end of the plunger head 28 of the plunger 25, when the actuating shaft is in the first position. When the actuating shaft 15 is moved to the second or safe position, the plunger 25 is forced forward to the second position and held in the second position by the periphery of the actuating shaft 15.

As the plunger 25 moves forward to the second position, the plunger locking head 22 moving in the bore 60 of the bolt sleeve 57, enters the locking notch 61 which is provided on Mauser rifles, and prevents turning of the breechbolt 55, locking the breechbolt 55 in a closed position.

When the actuating shaft 15 is moved back to the first position, the plunger 25 returns to engagement with the slot 17 in the actuating shaft under pressure of the spring 27 withdrawing the plunger locking head 22 from the notch 61 of the breechbolt 55 as the mechanism assumes the firing position.

The vertical actuating shaft version of the device as shown in the drawings in FIGS. 10 through 15 is constructed in the same manner as described above except that the actuating shaft 115 is mounted in the body 111 in a vertical position in the bore 142 and is held in place by the lock ring 114 which is installed in the groove 120. The body projection 121 is installed in the bore 60 of the rifle bolt sleeve 57 and is held in position by the clamp 137, the lip 138 of the clamp 137 engages the bolt sleeve and retaining the device. The clamp 137 is held by the screw 139.

When the handle 112 is moved to the rear, the actuating shaft 115 is rotated. The angled surface 116 mounted on the end of the actuating shaft 115 engages the angled surface 134 of the holding member 135 causing the holding member 135 to pivot downward on pin 136 which is through the bore 132 and the angled lip 133 mounted on the holding member 135 then engages the firing pin head 50 forcing said friring pin head slightly rearward out of engagement with the trigger sear 51 and holding the firing pin head 50 in the second or safe position.

The plunger locking head 22 is moved into the notch 61 of the breechbolt 55 as the rotation of the actuating shaft 115 forces the end 28 of the plunger 25 out of the recess 117 in the actuating shaft 115, locking the breechbolt 55 in a closed position. The firing mechanism then being in a second or safe position. The rifle firing pin 52 is now held in a safe position and cannot cause the firing of the rifle. When the handle 112 is moved forward to the first position the holding member 135 is allowed to return to the first position and the plunger head 22 is withdrawn from the notch 61 by force of the plunger spring 27 and the mechanism assumes the firing or first position.

Although but a few embodiments of the invention have been shown and described, it will be apparent to those skilled in the art that various changes and modifications may be made therein without departing from the spirit of the invention or from the scope of the appended claims.

What is claimed is:

1. A firearm safety mechanism comprising a holding and release means for releaseably engaging a firing pin, said holding and release means comprising a pivoted holding member for movement between first and second positions for holding and releasing a firing pin, respectively, shaft means mounted on said holding and release means, for movement between first and second positions, lever means mounted on said shaft means for movement between first and second positions, depressing means mounted on said shaft means for moving said holding member to its second position when said shaft means is moved to its second position, said holding member being movable to its first position after having moved to its second position when said shaft means is moved to a first position after having been moved from a first position to a second position, whereby when said shaft means is moved to its second position said holding member moves to its second position engaging a firing pin and holding said firing pin in a safe position and when said shaft means is moved from its second position to its first position said holding member is movable to its first position and a firing pin released to an unlocked position.

2. The structure as recited in claim 1 taken in combination with plunger means mounted on said holding and release means, said plunger means being movable between a first and second position, eccentric means mounted on said shaft means for moving said plunger means from its first position to its second position, spring means mounted on said plunger means urging said plunger from a second position after having moved from its first position to its second position, said plunger means when in its second position engaging a breechbolt to prevent turning, and disengaging a breechbolt when said plunger moves to its first position.

3. The structure as recited in claim 1 to include a retaining clamp means mounted on said holding and release means, an end portion of said clamp means engaging a surface of a firearm breechbolt mechanism for holding said holding and release means in a secured position.

4. The structure as recited in claim 1 to include wedging means mounted on said holding and release means, said wedging means causing a firing pin to move rearwards when said holding and release means is moved to a second position, said movement rearward providing clearance disengaging a firing pin from a trigger sear.

* * * * *